United States Patent [19]

Genovese et al.

[11] Patent Number: 4,675,032

[45] Date of Patent: Jun. 23, 1987

[54] VACUUM CLEANER BAG WITH OSCILLATING TUBE

[75] Inventors: Vincent P. Genovese, Ft. Worth; Lance R. Levine, El Paso, both of Tex.

[73] Assignee: Southwest Manufacturers & Distributors, Inc., Fort Worth, Tex.

[21] Appl. No.: 913,699

[22] Filed: Sep. 29, 1986

[51] Int. Cl.[4] ..... B01D 46/04

[52] U.S. Cl. ..... 55/96; 55/293; 55/298; 55/300; 55/368; 55/374; 55/380; 55/DIG. 2

[58] Field of Search ..... 55/96, 97, 296, 298, 55/300, 304, 364, 368, 374, 377, 380, 381, DIG. 2, 293

[56] References Cited

U.S. PATENT DOCUMENTS

| | | | |
|---|---|---|---|
| 1,999,826 | 4/1935 | Snell | 55/364 |
| 2,435,490 | 2/1948 | Beager et al. | 55/DIG. 2 X |
| 3,491,519 | 1/1970 | Ettridge | 55/357 |
| 3,971,643 | 7/1976 | Hufton | 55/372 |
| 4,119,414 | 10/1978 | Smaling | 55/97 |
| 4,262,384 | 4/1981 | Bowers | 15/328 |
| 4,554,698 | 11/1985 | Rennecker et al. | 15/339 |

FOREIGN PATENT DOCUMENTS

| | | | |
|---|---|---|---|
| 0599651 | 3/1948 | United Kingdom | 55/DIG. 2 |

*Primary Examiner*—Charles Hart

*Attorney, Agent, or Firm*—Charles D. Gunter, Jr.

[57] ABSTRACT

A bag is shown for use with an upright vacuum cleaner of the type having a motor fan contained in a main housing for producing an air flow out an air duct of the housing. The bag includes a flexible body having side walls formed of an air pervious material which define a normally closed interior and a mouth opening. The mouth opening of the flexible body is secured to the air duct of the main housing to produce an air flow through the flexible body for exhaust to the atmosphere. An oscillator tube, formed of a flexible material, has an interior, an open end at one extent and an intake opening at the opposite extent. The intake opening is arranged to communicate with the mouth opening of the bag body so that the air flow from the main housing passes through the oscillator tube and causes oscillations, the oscillations of the tube serving to vibrate the bag and prevent the buildup of dirt on the bag interior side walls.

13 Claims, 6 Drawing Figures

FIG. 1
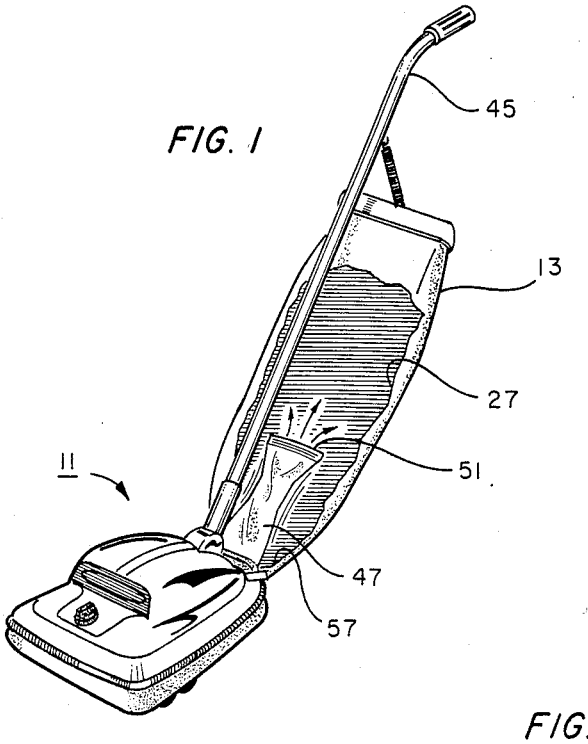
FIG. 2
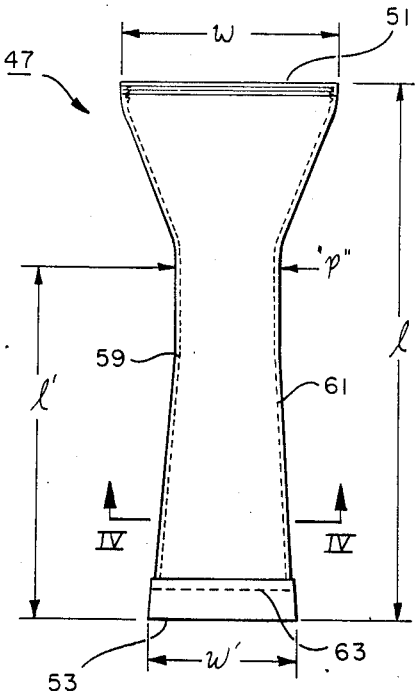
FIG. 3
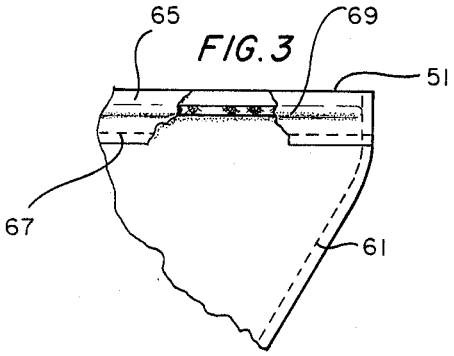
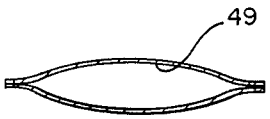
FIG. 4

VACUUM CLEANER BAG WITH OSCILLATING TUBE

BACKGROUND OF THE INVENTION

1. Field of the Invention

This invention relates generally to bag assemblies for upright vacuum cleaners, and more particularly, to a bag having an internal oscillator tube which vibrates the bag walls during use to dislodge dirt and prevent restrictions in air flow through the bag walls.

2. Description of the Prior Art

A vacuum cleaner removes dirt and other foreign material from a surface being cleaned and deposits them in a dirt collecting bag. The vacuum cleaner main housing carries a vacuum generating means referred to as a "motor-fan unit" which creates a flow of dirt laden air through the housing to the dirt collecting bag. The vacuum pressure generated in the main housing draws the dirt laden air through the housing and through an air duct into the dirt collecting bag which is attached by a mouth opening to the air duct.

The dirt collecting bag is formed of an air pervious material, such as cloth, and functions to filter all the dirt laden air and collect the dirt and dust within the bag. Filtered air passes through the bag side walls and is exhausted to the atmosphere. Due to the nature of the air flow through the housing and bag, dirt and dust particles tend to build up on the interior side walls of the bag. As dirt cakes the bag interior side walls, the porosity of the bag decreases and air flow is restricted. As the air flow through the bag gradually decreases, the vacuum pressure in the main housing decreases and vacuum efficiency is reduced.

It is an object of the present invention to provide a bag for an upright vacuum cleaner which provides increased vacuuming efficiency and which has a longer useful life than conventional bags.

Another object of the invention is the provision of an oscillating means within the bag which provides self-cleaning of the bag walls to reduce the restriction of air flow normally associated with plugging.

Another object of the invention is the provision of an oscillator tube within the vacuum bag which acts to disperse the vacuumed dirt in a more random pattern to reduce abrasion which normally occurs on the bag interior side walls.

Another object of the invention is to provide such a bag which is simple in design and economical to manufacture and which does not utilize mechanical moving parts which would require maintenance.

SUMMARY OF THE INVENTION

The foregoing objects are accomplished by the bag of the invention which is designed for use on an upright vacuum cleaner of the type having an air flow generating means contained in a main housing for producing an air flow out an air duct of the housing. The bag includes a flexible body having side walls formed of an air pervious material which define a normally closed interior and a mouth opening. Connecting means are provided for securing the mouth portion of the flexible body to the air duct of the main housing to thereby produce an air flow through the flexible body for exhaust to the atmosphere. Oscillating means are located within the bag interior and communicate with the mouth opening of the bag body so that the air flow from the main housing passes through the oscillating means and actuates the oscillating means to cause oscillations, the resulting oscillations serving to vibrate the bag.

Preferably, the oscillating means is an oscillator tube formed of a flexible material and having an interior defined by a length and width. The tube has an open end at one extent and an intake opening at the opposite extent. The width of the oscillator tube decreases from the intake opening to an intermediate point and then flares from an intermediate point to the open end. The intake opening of the oscillator tube is arranged to communicate with the mouth opening of the bag body so that air flowing from the main housing passes through the oscillator tube at a given velocity. The air velocity decreases above the intermediate point in the tube, due to the Venturi effect, and the resulting air turbulence which is created causes oscillations in the tube. The oscillating tube vibrates the bag interior side walls and prevents the buildup of dirt on the side walls.

Additional objects, features and advantages will be apparent in the written description which follows.

BRIEF DESCRIPTION OF THE DRAWINGS

FIG. 1 is a perspective view of an upright vacuum cleaner and bag of the invention with the bag side walls partly broken away for ease of illustration.

FIG. 2 is a simplified, top view of the oscillator tube of the bag of FIG. 1.

FIG. 3 is a partial, close-up view of the open end of the oscillator tube of FIG. 2 showing the stitching thereof.

FIG. 4 is a cross-sectional view taken along lines IV—IV in FIG. 2.

DETAILED DESCRIPTION OF THE INVENTION

Figure 5:
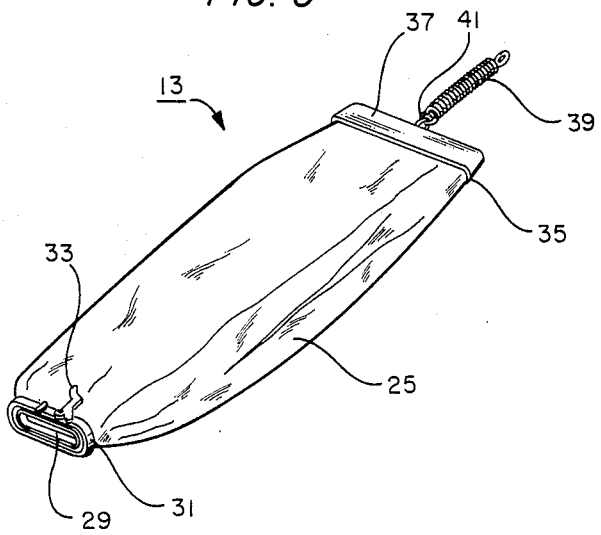
FIG. 5 is an isolated, perspective view of the bag of FIG. 1.

FIG. 1 shows an upright vacuum cleaner 11 which features a bag 13 of the invention. As shown in simplified fashion in FIG. 6, the vacuum cleaner 11 includes a coventional main housing 15, nozzle region 17, rotary agitator 19, and a vacuum generating means or motor-fan unit 21. The motor-fan unit creates a flow of dirt laden air, shown by the arrows in FIG. 6, through the main body 15 to a dirt collecting bag 13. Vacuum pressure is generated at the nozzle region 17 and the dirt laden air is pressurized by the motor-fan unit and forced through the main body, through air duct 23 and into the dirt collecting bag 13 which is attached to the duct 23.

Upright vacuum cleaners of the type under consideration are well known in the art. Such a device is commercially available from Southwest Manufacturers & Distributors, Inc., as the POWR-FLITE commercial upright model P-747. Commercial vacuum cleaners of the type under consideration feature a "dump-out" cloth bag and do not typically use an internal cloth or paper filter bag.

Figure 6:
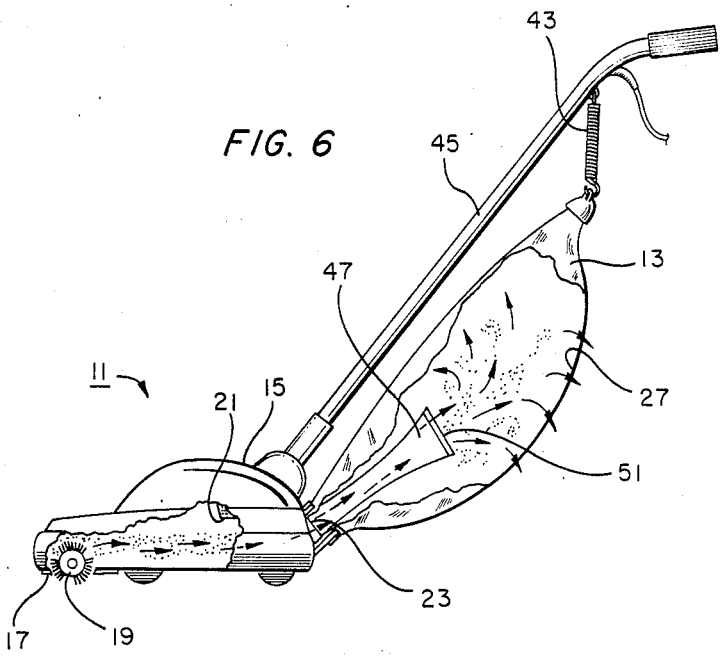
FIG. 6 is a simplified, schematic view of the air flow through the upright vacuum cleaner of FIG. 1 during operation.

As shown in FIGS. 5 and 6, the bag of the invention includes a flexible body having side walls 25, the body being formed of an air pervious material such as cloth. The side walls define a normally closed interior 27 and a mouth opening 29. The mouth opening 29 includes a metal band clamp 31 with a latch 33 for connecting the mouth portion of the flexible body to the air duct 23 of the main housing 15 to thereby produce an air flow through the flexible body for exhaust to the atmosphere. The outer bag 13 is of tubular-like construction and includes a top or upper end 35 which is connected to a bag clip 37. The bag clip 37 can be removed to allow the upper end 35 to be opened so that the bag can be "dumped" to empty the contents. A resilient means such as spring 39 is connected to an eyelet 41 of the bag clip 37 and is connected to a hook 43 on a pivoting handle 45 for support of the bag at its uppermost extension alongside the generally vertically extending pivoting handle.

The bag of the invention also features an oscillating means such as oscillator tube 47 which is located within the bag interior 27 and which communicates with the mouth opening 29 of the bag body. Preferably, the oscillator tube is formed of a flexible material and has an interior 49, an open end 51 at one extent and an intake opening 53 at the opposite extent. Although various flexible wear resistant materials can be utilized, nylon is preferred for its strength, light weight and relatively slick surface or texture. The most preferred material is 420 denier coated nylon and is relatively non-porous as compared to the cloth material of the bag 13. The intake opening 53 of the tube 47 is arranged to communicate with the mouth opening 29 of the bag body so that the air flow from the main housing 15 passes through the oscillator tube 47 on its way to the bag interior 27. Preferably, the intake opening 53 of the tube 47 is concentrically arranged within the mouth opening 29 of the bag 13 so that the bag mouth opening and clamp 31 circumscribe the intake opening 53 of the tube. In any case, the air flow from the air duct 23 passes first through the tube interior 49 and then into the bag interior 27.

As shown in greater detail in FIGS. 2 and 6, the tube 47 forms an interior flow path (indicated by the arrows in FIG. 6) for directing air from the intake opening 53 to the tube open end 51. The flow path is designed with a predetermined "Venturi-style" profile to produce exhaust turbulence in the air flow exiting the open end 51. The Venturi effect is well known in science and is most often described with reference to a short tube with a constricted throat that is used to determine fluid pressures and velocities by measurement of differential pressures generated at the throat as a fluid traverses the tube.

As shown in FIG. 2, the tube has an overall length "1", a width "w" at the open end 51 and a width "w'" at the intake opening 53. The width of the oscillator tube varies between the intake opening 53 and the open end 51. More particularly, the width "w'" decreases from the intake opening 53 to an intermediate point "p" and then flares outwardly from the intermediate point to the width "w" at the open end 51. The Venturi effect operates as follows: Air flows from the main housing 15 at a given velocity and enters the intake opening 53 of the tube. As the air passes above the intermediate point "p", the increased diameter of the tube causes a sudden decrease in air velocity. The turbulence caused by the high velocity air which is entering the intake opening 53 rapidly overtaking the slower air that has already passed through the point "p" results in a flapping action or oscillation of the tube which causes the tube 47 to beat or vibrate the interior side walls 27 of the bag 13. As the tube 47 beats against the side walls of the bag 13, dirt is dislodged from the bag side walls and is deposited at the bottom of the bag chamber (generally at the area 57 in FIG. 1). The tube open end 51 also provides an entry point for the dirt laden air into the bag chamber above the collection area 57 of dirt which has already been vacuumed into the bag 13.

As shown in FIG. 2, the material of the tube 47 can be cut and stitched along the sides 59, 61 during manufacture. The seams are turned to the outside of the tube to present a smooth surface to the incoming dirt laden air to maintain the maximum air velocity at the intermediate point "p". A single piece of material could also be doubled over and stitched along only one side 59. As shown in FIG. 2, the intake opening 53 is turned back to the outside and stitched along a seam 63. As shown in FIG. 3, the open end 51 is turned back and stitched along parallel seams 65, 67. The seams 65, 67 form a hem for a rope 69 which passes about the circumference of the open end 51 to provide added strength and wear resistance.

In a specific example, a tube 47 was manufactured from 420 denier nylon having the following dimensions:

"l": 16.75 inches
"w": 7.875 inches
"1'": 12.0 inches
"p": 3.75 inches
"w'": 4.875 inches.

The overall length of the bag 13 was 28 inches.

An invention has been provided with several advantages. The vacuum cleaner bag of the invention with its internal oscillator tube improves vacuuming efficiency by maintaining maximum air flow through the bag side walls. The oscillation of the internal tube vibrates the bag side walls, thus preventing the buildup of dirt and dust in the bag interior side wall regions. The oscillation of the tube also acts to distribute the dirt in a more random pattern, thereby decreasing the wear on the bag interior. The oscillator tube design is simple and inexpensive and adds little to the manufacturing cost of the bag while greatly increasing the vacuuming efficiency and extending bag life.

While the invention has been shown in only one of its forms, it is not thus limited but is susceptible to various changes and modifications without departing from the spirit thereof.

We claim:

1. A bag for an upright vacuum cleaner of the type having an air flow generating means contained in a main housing for producing an air flow out an air duct of the housing, the bag comprising:

a flexible body having side walls formed of an air pervious material which define a normally closed interior and a mouth opening;

connecting means for securing the mouth portion of the flexible body to the air duct of the man housing to thereby produce an air flow through the flexible body for exhaust to the atmosphere; and oscillating means located within the bag interior and communicating with the mouth opening of the bag body so that the air flow from the main housing passes through the oscillating means and actuates the oscillating means to cause oscillations, the resulting oscillations serving to vibrate the bag.

2. A bag for an upright vacuum cleaner of the type having an air flow generating means contained in a main housing for producing an air flow out an air duct of the housing, the bag comprising:

a flexible body having side walls formed of an air pervious material which define a normally closed interior and a mouth opening;

connecting means for securing the mouth portion of the flexible body to the air duct of the main housing to thereby produce an air flow through the flexible body for exhaust to the atmosphere; and a oscillator tube formed of a flexible material having an interior, an open end at one extent and an intake opening at the opposite extent, the intake opening of the oscillator tube being arranged to communicate with the mouth opening of the bag body so that the air flow from the main housing passes through the oscillator tube and causes oscillations, the oscillations of the tube serving to vibrate the bag.

3. The bag of claim 2, wherein the oscillator tube forms an interior flow path for directing air from the intake opening to the open end, the flow path being designed with a predetermined profile to produce exhaust turbulence in the air flow exiting the open end.

4. The bag of claim 3, wherein the oscillator tube has a length and a width, and wherein the width of the oscillator tube varies between the intake opening and the open end.

5. The bag of claim 4, wherein the width of the oscillator tube decreases from the intake opening to an intermediate point and then flares outwardly from the intermediate point to the open end.

6. A bag for an upright vacuum cleaner of the type having an air flow generating means contained in a main housing for producing an air flow out an air duct of the housing, the bag comprising:

a flexible body having side walls formed of an air pervious material which define a normally closed interior and a mouth opening;

connecting means for securing the mouth portion of the flexible body to the air duct of the main housing to thereby produce an air flow through the flexible body for exhaust to the atmosphere; and an oscillator tube formed of a flexible material and having an interior defined by a length and a width, an open end at one extent and an intake opening at the opposite extent, and wherein the width of the oscillator tube decreases from the intake opening to an intermediate point and then flares from the intermediate point outwardly to the open end, the intake opening of the oscillator tube being arranged to communicate with the mouth opening of the bag body so that air flowing from the main housing passes through the oscillator tube at a given velocity, and wherein a decrease in air velocity is created above the intermediate point in the tube which causes oscillations, the oscillations of the tube serving to vibrate the bag.

7. The bag of claim 6, wherein the interior flow path formed by the oscillator tube constitutes a venturi profile.

8. The bag of claim 7, wherein the oscillator tube is formed of nylon fabric.

9. The bag of claim 8, wherein the oscillator tube seams are all sewn to the outside of the tube to present a smooth surface to the incoming air flow to keep the velocity of the air flow at a peak value.

10. The bag of claim 9, wherein the mouth opening of the bag circumscribes the intake opening of the oscillator tube so that air from the intake duct of the main housing pases through the intake opening of the oscillator tube and into the bag interior before being exhausted through the pervious side walls of the bag to the atmosphere.

11. An upright vacuum cleaner, comprising:

a pivoting handle extending from a main housing;

a bag defined by a flexible body having side walls formed of an air pervious material which define a normally closed interior and a mouth opening, the bag extending along the pivoting handle and including a top end portion;

air flow generating means carried in the main housing for producing an air flow out of an air duct, the mouth opening of the bag being connected to the air duct so that air flows through the bag for exhaust to the atmosphere;

clasp means connected to the bag top end portion and interconnected with the pivoting handle for supporting the bag on the handle; and oscillating means located within the bag interior and communicating with the mouth opening of the bag body so that the air flow from the main housing passes through the oscillating means and actuates the oscillating means to cause oscillations, the resulting oscillations serving to vibrate the bag to prevent the buildup of dirt on the bag interior side walls.

12. An upright vacuum cleaner, comprising:

a pivoting handle extending from a main housing;

a bag defined by flexible body having side walls formed of an air pervious material which define a normally closed interior and a mouth opening, the bag extending along the pivoting handle and including a top end portion;

air flow generating means carried in the main housing for producing an air flow out of an air duct, the mouth opening of the bag being connected to the air duct so that air flows through the bag for exhaust to the atmosphere;

clasp means connected to the bag top end portion and interconnected with the pivoting handle for supporting the bag on the handle; and an oscillator tube formed of a flexible material and having an interior defined by a length and a width, an open end at one extent and an intake opening at the opposite extent, and wherein the width of the oscillator tube decreases from the intake opening to an intermediate point and then flares from the intermediate point outwardly to the open end, the intake opening of the oscillator tube being arranged to communicate with the mouth opening of the bag body so that air flowing from the main housing passes through the oscillator tube at a given velocity, and wherein a decrease in air velocity is created above the intermediate point in the tube which causes oscillations, the oscillations of the tube serving to vibrate the bag.

13. A method of reducing the buildup of dirt within the interior of a vacuum cleaner bag used on an upright vacuum cleaner, where the vacuum cleaner has a main housing with an air flow generating means for producing an air flow out an air duct and wherein the bag has a flexible body having side walls formed of an air pervious material which define a normally closed interior and a mouth opening, the mouth opening being connected to the air duct to produce an air flow through the bag interior to exhaust to the atmosphere, the method comprising the steps of:

providing an oscillator tube for installation within the bag interior, the oscillator tube being formed of a flexible material and having an interior defined by a length and a width, an open end at one extent and an intake opening at the opposite extent, and wherein the width of the oscillator tube decreases from the intake opening to an intermediate point and then flares from the intermediate point outwardly to the open end; and arranging the intake opening of the oscillator tube within the bag interior to communicate with the mouth opening of the bag body so that air flowing from the main housing passes through the oscillator tube at a given velocity, and wherein a decrease in air velocity is created above the intermediate point in the tube which causes oscillations, the oscillations of the tube serving to vibrate the bag.

* * * * *

UNITED STATES PATENT AND TRADEMARK OFFICE

CERTIFICATE OF CORRECTION

PATENT NO. : 4,675,032

DATED : June 23, 1987

INVENTOR(S) : Vincent P. Genovese and Lance R. Levine

It is certified that error appears in the above-identified patent and that said Letters Patent is hereby corrected as shown below:

ON THE COVER PAGE, UNDER ASSIGNEE, please delete "Southwest Manufacturers & Distributors, Inc.

Signed and Sealed this

Ninth Day of February, 1988

*Attest:*

DONALD J. QUIGG

*Attesting Officer*

*Commissioner of Patents and Trademarks*